United States Patent [19]

Itaya

[11] Patent Number: 4,792,225

[45] Date of Patent: Dec. 20, 1988

[54] DEVELOPING APPARATUS

[75] Inventor: Keiji Itaya, Yokohama, Japan

[73] Assignee: Kabushiki Kaisha Toshiba, Kawasaki, Japan

[21] Appl. No.: 91,331

[22] Filed: Aug. 31, 1987

Related U.S. Application Data

[63] Continuation of Ser. No. 661,561, Oct. 16, 1984, abandoned.

[30] Foreign Application Priority Data

Oct. 26, 1983 [JP] Japan ..... 58-200226

[51] Int. Cl.[4] ..... G03G 15/01; G03G 15/09

[52] U.S. Cl. ..... 355/3 DD; 118/645; 118/657; 355/4

[58] Field of Search ..... 355/3 R, 3 DD, 4, 14 D; 118/645, 657, 658

[56] References Cited

U.S. PATENT DOCUMENTS

| | | | |
|---|---|---|---|
| 4,131,357 | 12/1978 | Forbes | 355/3 DD |
| 4,264,185 | 4/1981 | Ohta | 355/4 |
| 4,266,868 | 5/1981 | Bresina et al. | 355/3 DD |
| 4,292,921 | 10/1981 | Kroll et al. | 118/658 X |
| 4,308,821 | 1/1982 | Matsumoto et al. | 355/4 XR |
| 4,351,604 | 9/1982 | Karasawa et al. | 355/3 DD X |
| 4,384,545 | 5/1983 | Burnham et al. | 118/658 X |

*Primary Examiner*—Fred L. Braun

*Attorney, Agent, or Firm*—Cushman, Darby & Cushman

[57] ABSTRACT

A developing apparatus includes a vessel, set near a photosensitive drum and contains at least two magnetic developers bearing different colors, and at least two developing rollers which are held in the vessel and which deposit the developer on the surface of the photosensitive drum. In the apparatus, each developing roller includes a cylindrical rotatable sleeve prepared from a nonmagnetic material and a fixed magnetic roller received in the sleeve. On the peripheral portion of the magnetic roller, a number of charged magnetic poles with alternating polarities are arranged on such a manner that the polarity of the poles facing each other on the adjacent developing rollers is the same. Matching up polarities in this manner prevents the production of a magnetic flux between the adjacent developing rollers.

7 Claims, 3 Drawing Sheets

DEVELOPING APPARATUS

This is a continuation of Ser. No. 661,561, filed 10/16/84, now abandoned.

BACKGROUND OF THE INVENTION

1. Field of the Invention

This invention relates to a developing apparatus used with, for example, an electronic copying apparatus.

2. Description of the Related Art

With an electronic copying apparatus, an original image is formed on a sensitive drum in the form of a static latent image. The latent image is made visible when applied with a developer. When a visible image formed on the photosensitive drum is transcribed on a paper sheet, the original is fully copied. The developer is formed of a toner acting as a coloring material with magnetic particles. This developer is magnetically transported to the photosensitive drum from a closely set developing vessel to be deposited in a latent image formed on the photosensitive drum. For the transport of the developer, a developing roller unit is received in the developing vessel. The developing roller comprises a cylindrical nonmagnetic sleeve and a plurality of magnets held in the sleeve. The developer is attracted to the sleeve by the magnetic force by the magnets. Then, the developer is transported by the rotation of the sleeve over its surface to the photosensitive drum. The toner is deposited on the latent image. The latent image is thus developed. In this connection, a multiroller type developing apparatus is known which comprises a plurality of developing rollers, received in a developing vessel, for the object of ensuring the efficient transportation/-deposition of a single color developer or ensuring the transportation/deposition of a multicolor developer for color copying. However, this developing apparatus is accompanied with the drawbacks that if the adjacent rollers are narrowly spaced from each other, a magnetic flux is generated between the mutually-facing magnets of the adjacent developing rollers. In this case, a magnetic field acting in the normal direction of the sleeve circumference is more intensified than a magnetic field acting in the circumferential direction of the sleeve, thereby obstructing the transportation of the developer. Therefore, a distance between the respective developing rollers has to be widened in order to prevent a magnetic field acting in the normal direction from being stronger than a magnetic field acting in the circumferential direction of the sleeve. This undesirably leads to the enlargement of a developing apparatus.

Summary of the Invention

It is accordingly the object of this invention to provide a compact multiroller type developing apparatus which can surely transport a developer to an object of development. To attain this object, this invention provides a developing apparatus which comprises a vessel, containing a magnetic developer, set near an object of development and at least two developing rollers held in the vessel, each of which includes a cylindrical rotatable nonmagnetic sleeve and a plurality of magnets with alternating polarities fixedly provided in the sleeve. The polarity of the magnets facing each other in the adjacent developing rollers is the same.

DETAILED DESCRIPTION OF THE PREFERRED EMBODIMENTS

Figure 1:
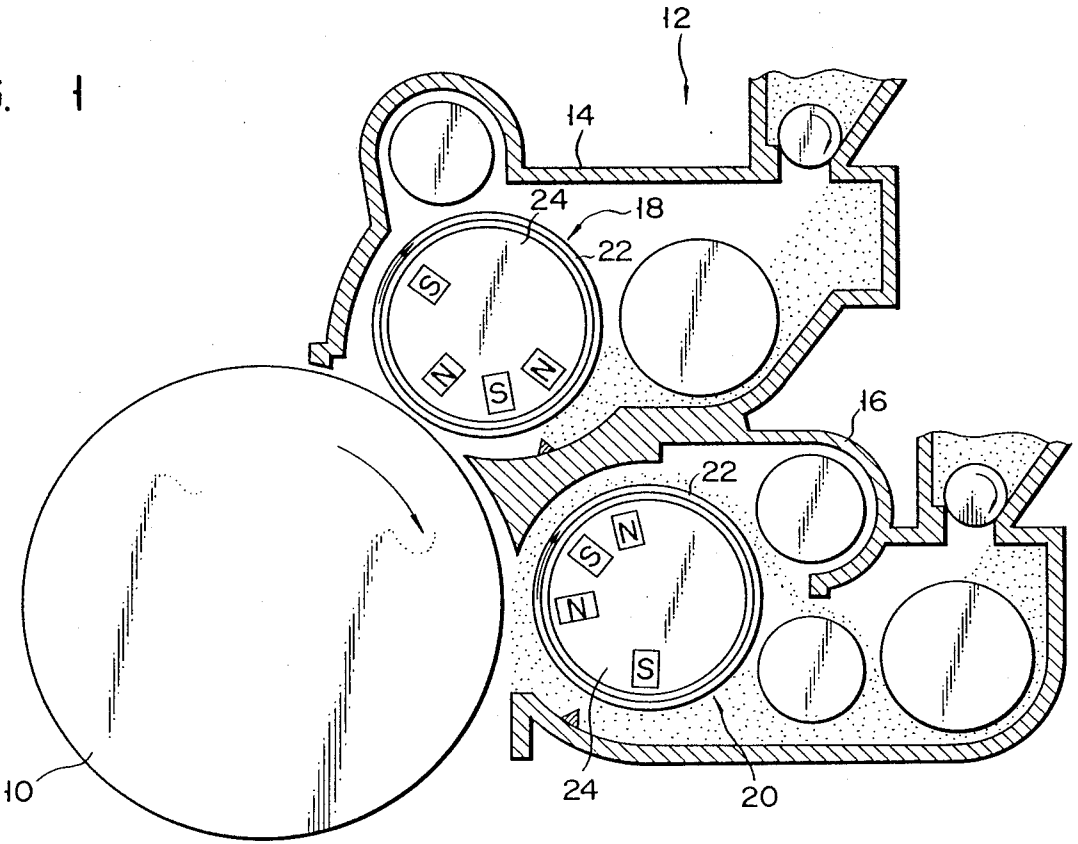
FIG. 1 is a cross sectional view of a developing apparatus according to a first embodiment of this invention.

A description may now be made with reference to FIG. 1 of a developing apparatus according to a first embodiment of this invention. FIG. 1 is a cross sectional view of the developing apparatus of the invention applied to a 2-color electronic copying device. A static latent image is formed on the surface of a photosensitive drum 10 by means of an illumination lamp and optical system (neither shown). A developing unit 12 is set near the photosensitive drum 10. This developing unit 12 supplies, for example, black and red developers to the surface of the photosensitive drum 10 to develop a static latent image. The developing unit 12 comprises integral vessels 14 and 16 formed of a nonmagnetic material. The vessels 14 and 16 respectively contain black and red developers. The developer may be a 2-component type formed of a conductive magnetic particle called a carrier and dielectric toners which are formed of a synthetic resin and coloring material (a block coloring material is, for example, carbon) and which are attached around the carrier, or a one component type composed of a toner including magnetic particles. Installed in those interior portions of the vessels 14 and 16, which lie near the photosensitive drum 10, are developing rollers 18 and 20 intended to deposit the developer on the photosensitive drum 10. The developing rollers 18 and 20 have the same arrangement, each comprising a cylindrical nonmagnetic sleeve 22 and a magnetic roller 24 which is received in the sleeve 22 and on whose peripheral portion a plurality of magnetic poles with alternating polarities S and N are arranged. A magnetic flux is generated between the adjacent magnetic poles S and N arranged on the same magnetic roller 24, thereby attracting the developer held in the vessel to the surface of the sleeve 22. The magnetic roller 24 remains fixed. The sleeve 22 is rotated by a motor (not shown). Therefore, the developer is transported to the photosensitive drum 10 over the surface of the sleeve 22, causing a sensitive latent image formed on the photosensitive drum 10 to be developed. In this case, while one of sleeves 22 of the developing rollers 18 and 20 is rotated, the other stands at rest.

Figure 2:
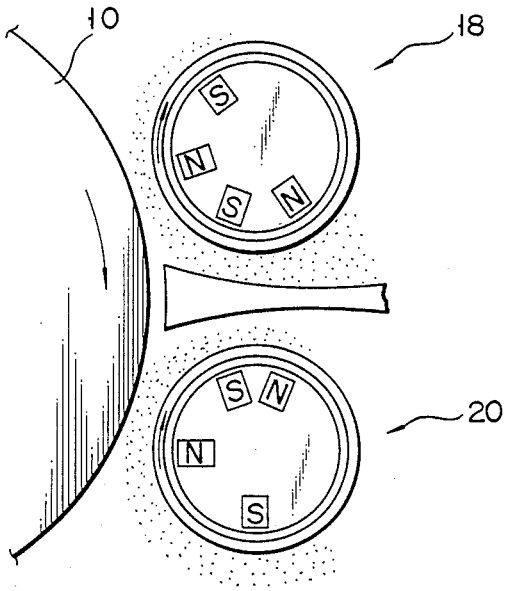
FIG. 2 illustrates the operation of this first embodiment.
Figure 3:
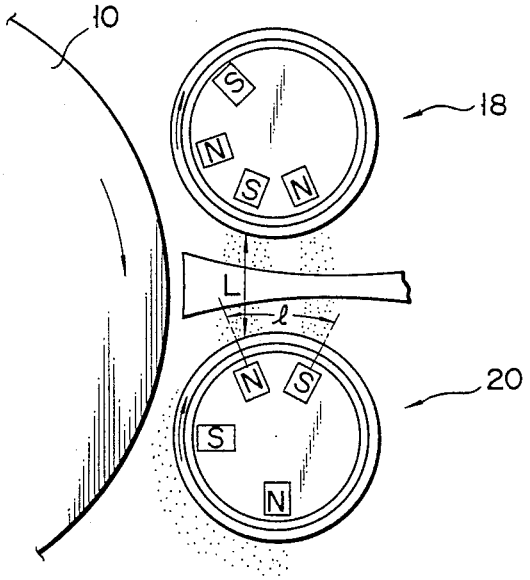
FIG. 3 (PRIOR ART)
FIG. 3 shows the operation of the conventional developing apparatus in the corresponding relationship to FIG. 2.

The polarity of the magnetic poles facing to each other of the developing rollers 18 and 20 is the same. Consequently as shown in FIG. 2, no magnetic flux is generated between the same mutually facing magnetic poles of the developing rollers 18 and 20. Thus, matching up the polarity of facing magnetic poles prevents the production or generation of a magnetic flux between the developing rollers. A magnetic flux is generated between the adjacent opposite polarity poles of each magnetic roller 24. As a result, a magnetic field acting in the circumferential direction of the sleeve 22 causes the developer to be tightly attracted to the surface of the sleeve 22. When, therefore, the sleeve 22 is rotated, the developer deposited on its surface is jointly rotated and transported to the photosensitive drum 10. If the polarity of the magnetic poles facing to each other of the developing rollers 18 and 20 is not the same as shown in FIG. 3, a magnetic flux is produced between the developing rollers 18 and 20, thereby causing a magnetic field acting in the normal direction of the surface of the sleeve 22 to be stronger than a magnetic field acting in the circumferential direction thereof. Even when, therefore, the sleeve 22 is rotated, the developer is prevented from being carried along the sleeve 20 because of the obstructing force of the stronger, normally-acting magnetic field. Especially when L is smaller than l, the developer can not be transported. To eliminate this drawback, it is necessary to broaden a space between the developing rollers 18 and 20. As shown in FIG. 2, however, the developing apparatus of this invention makes it unnecessary to broaden a distance between the developing rollers 18 and 20, offering the advantage that the apparatus can be miniaturized without reducing the developer-transporting capacity. Thus, as FIG. 2 illustrates, providing poles of the same polarity in facing relation constitutes a means for preventing the production of a magnetic flux between the rollers.

Figure 4:
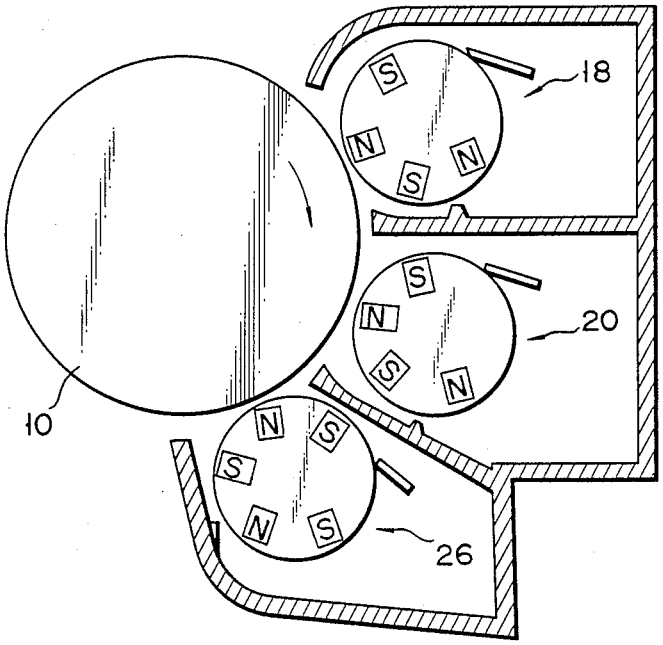
FIG. 4 is a cross sectional view of a developing apparatus according to a second embodiment of the invention.

With the developing apparatus embodying this invention, the developing conditions such as the quantity of a developer transported per unit time and the rotation frequency of the sleeve are substantially made to conform to the conditions involved in the known developing process. It will be noted that this invention is not limited to the foregoing embodiment, but is applicable to a type involving three developing rollers shown in FIG. 4, and also to a multistage roller type developing apparatus used with a single color copying device.

What is claimed is:

1. A developing apparatus comprising:

vessel means provided near an object of development and including at least two vessels, said vessels containing respective and different magnetic developers;

at least one developing roller respectively held in each of said vessels so that each of said developers is delivered by a different developing roller, each of said developing rollers including a cylindrical rotatable nonmagnetic sleeve and a magnetic roller disposed within the sleeve having a plurality of magnets by which to attract said respective magnetic developers to the surface of the sleeve, each of said plurality of magnets having a polarity opposite to that of adjacent magnets;

means for preventing the production of a magnetic flux between said developing rollers which causes a magnetic field acting in the normal direction of the surface of the sleeve of each said roller that is stronger than a magnetic field acting in the circumferential direction of each said sleeve, said means for preventing including means for mounting said magnetic rollers so that said magnetic rollers are spaced apart a distance less than a distance at which the magnets of each said magnetic roller are spaced apart from one another and so that the polarity of the magnets facing each other from the adjacent developing rollers is identical; and means for rotating the sleeve of each roller one by one.

2. A developing apparatus according to claim 1, wherein said vessel means is formed of a nonmagnetic material.

3. A developing apparatus according to claim 1, wherein each of said developers is a 2-component type, formed of conductive magnetic particles, called a carrier, and dielectric toners, formed of a synthetic resin and coloring material and which are attached around the carrier.

4. A developing apparatus according to claim 1, wherein each of said developers is a one component type composed of a toner including magnetic particles.

5. An apparatus according to claim 1, wherein each said developing roller deposits the developer on the surface of the object of development.

6. An apparatus according to claim 1, wherein at least one of said plurality of magnets included in the magnetic roller is opposite to the object of development, some of the remaining magnets face the magnets of another roller, and the polarities of the magnet facing one another are the same.

7. An apparatus according claim 1, wherein said magnetic roller is fixedly mounted.

* * * * *